US006397526B1

(12) United States Patent
Saul et al.

(10) Patent No.: US 6,397,526 B1
(45) Date of Patent: Jun. 4, 2002

(54) RAIN GUTTER CLEANER AND METHOD OF USING THE SAME

(76) Inventors: Gregory W. Saul, 12412 Cominger Dr.; Jeremy R. Holst, 20371 S. Meadow Ave., both of Oregon City, OR (US) 97045

( * ) Notice: Subject to any disclaimer, the term of this patent is extended or adjusted under 35 U.S.C. 154(b) by 0 days.

(21) Appl. No.: 09/515,817

(22) Filed: Feb. 29, 2000

(51) Int. Cl.[7] ..... E04D 13/064; E04D 13/076

(52) U.S. Cl. ..... 52/16; 52/11; 52/14; 52/12; 52/302.1; 52/302.7; 4/394; 4/396

(58) Field of Search ..... 52/16, 14, 11, 52/12, 13, 15, 302.7, 302.1; 73/322.5; 210/111; 248/48.1, 48.2; 137/429; 441/133; 4/394, 396

(56) References Cited

U.S. PATENT DOCUMENTS

| | | | | | |
|---|---|---|---|---|---|
| 606,906 | A | * | 7/1898 | Zertuche | 137/429 |
| 1,011,669 | A | * | 12/1911 | Temme | 52/16 |
| 1,322,189 | A | * | 11/1919 | Holt | 52/16 |
| 1,440,478 | A | * | 1/1923 | McKee | 52/16 |
| 1,587,404 | A | * | 6/1926 | Nicholson | 73/322.5 |
| 1,878,947 | A | * | 9/1932 | Luff et al. | 137/429 |
| 1,942,616 | A | * | 1/1934 | Sandlin | 73/322.5 |
| 2,358,472 | A | * | 9/1944 | Owens | 4/396 |
| 2,383,507 | A | * | 8/1945 | Martin | 441/133 |
| 2,523,435 | A | * | 9/1950 | Jones | 52/16 |
| 2,640,593 | A | * | 6/1953 | Korb | 52/16 |
| 2,807,368 | A | * | 9/1957 | Blau | 52/16 |
| 2,994,433 | A | * | 8/1961 | Sandin | 52/14 |
| 3,157,002 | A | * | 11/1964 | Herman | 52/16 |
| 3,638,369 | A | * | 2/1972 | Albrecht | 52/16 |
| 4,241,547 | A | * | 12/1980 | Bove | 52/11 |
| 4,602,460 | A | * | 7/1986 | Langenbach | 52/1 |
| 5,535,554 | A | * | 7/1996 | Harris, Jr. | 52/12 |
| 5,743,138 | A | * | 4/1998 | Cheng | 73/322.5 |
| 6,035,580 | A | * | 3/2000 | Carter | 52/12 |
| 6,141,916 | A | * | 11/2000 | Shackelford | 52/12 |

* cited by examiner

*Primary Examiner*—Carl D. Friedman
*Assistant Examiner*—Phi Dieu Tran A
(74) *Attorney, Agent, or Firm*—Ingrid McTaggart

(57) ABSTRACT

A gutter cleaner comprises a float portion and a stem portion. The float portion comprises a float piece that typically has a size larger than the downspout opening of a gutter in which the gutter cleaner is installed. Accordingly, the float will not flow down or become lodged in the downspout. The float piece is made of materials or in a manner such that the float piece will be raised within the gutter when water flows there through. The stem portion typically is attached to the float portion and extends downwardly into the downspout of the gutter. As rainwater flows into the gutter and down the downspout, the water will raise the float while the stem portion will remain extending downwardly into the downspout. The flow of the water agitates the stem and the float regions of the gutter cleaner. This agitation action reduces the buildup of small twigs and pine needles at the downspout region, thereby facilitating the flow of debris and water down the downspout and out of the gutter.

4 Claims, 4 Drawing Sheets

Fig. 1
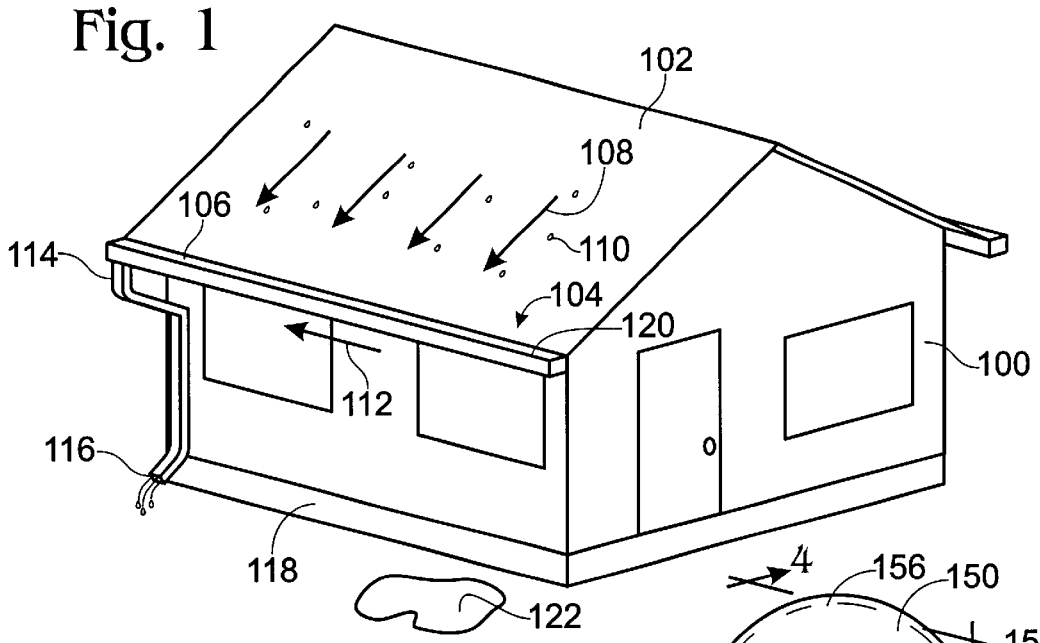
Fig. 2
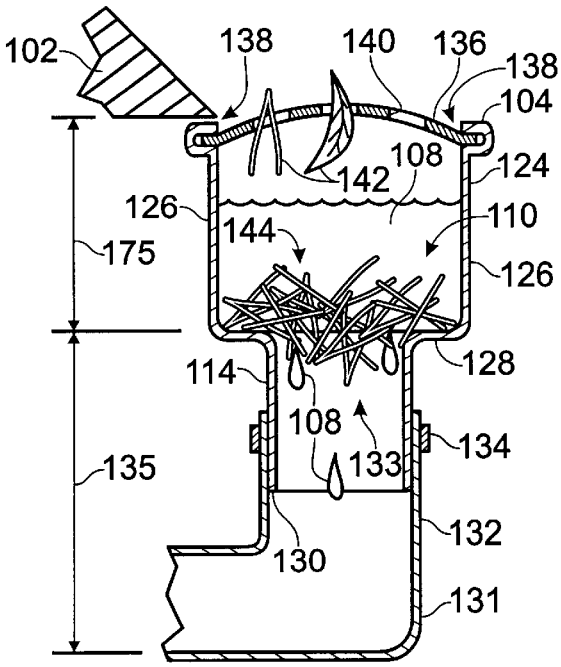
Fig. 3
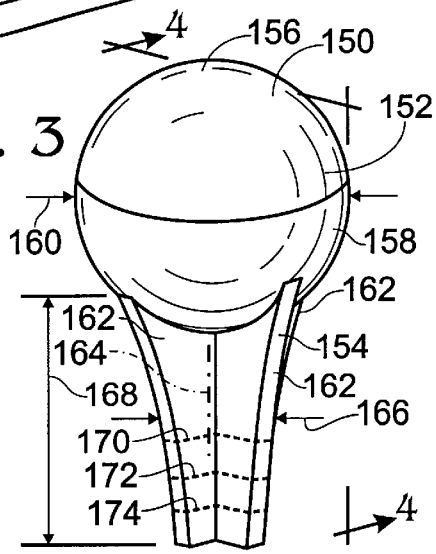
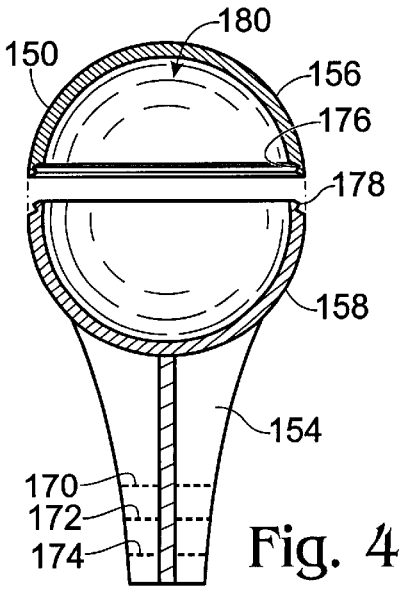
Fig. 4

RAIN GUTTER CLEANER AND METHOD OF USING THE SAME

TECHNICAL FIELD

The present invention relates to a rain gutter cleaner and a method of using the same, and more particularly, to a rain gutter cleaner which is positioned in the downspout region of a rain gutter and which agitates water and debris at said downspout region to facilitate flow of the water and debris down the downspout, thereby reducing buildup of such debris and clogging of the gutter.

BACKGROUND OF THE INVENTION

Residential and commercial buildings typically include along their roofline a rain gutter system that collects rain falling on the roof and channels the rain down a downspout and away from the foundation of the building. These gutters often times are connected to underground sewer or water drainage systems so that the immediate area around the foundation of the building does not become saturated.

Many of these residential and commercial buildings have tall trees growing nearby with branches that extend over the roof of the building. Debris such as leaves, pine needles, nuts, seed pods, small branches and twigs, pieces of moss, and the like, often fall onto and accumulate on the roof of the building. When rain falls on the roof, the rain causes the debris to flow into the rain gutter. The debris often times accumulates in the downspout region of the rain gutter and forms a dam so that water flow out of the gutter and down the downspout is hindered or even stopped. When water flow down the downspout is inhibited, rainwater will accumulate along the length of the gutter and begin to flow over the edge of the gutter and onto the ground adjacent the building's foundation. This may lead to pooling of water around the building, water in the building's basement, dry-rot in the rooting materials, and eventually, deterioration of the building's foundation.

The process of cleaning out gutters typically is accomplished by moving a ladder along the length of the gutter and scooping out the debris with one's hand or with a gutter trowel. This cleaning process is dangerous due to height of the gutters along the roofline. Moreover, gutters often become clogged during windy winter months such that cleaning of the gutters must be undertaken in dark, windy, cold and rainy conditions.

To alleviate the problem of debris accumulating at the downspout region of a gutter, some building owners install mesh netting along the top region of their rain gutters. This netting typically prevents large leaves and branches from accumulating at the downspout region. However, small twigs and thin pine needles easily slide through the openings in the mesh netting and accumulate at the downspout region.

Accordingly, there is a need for a gutter cleaner which reduces the accumulation of debris, especially small twigs and pine needles, in the downspout region of a rain gutter. Moreover, there is a need for a gutter cleaner which reduces the periodic requirement of a building owner to climb a ladder and manually clean out the downspout region of their rain gutters.

SUMMARY OF THE INVENTION

Accordingly, an object of the present invention is to provide a gutter cleaner that reduces the accumulation of debris, especially small twigs and pine needles, in the downspout region of a rain gutter.

Another object of the present invention is to provide a gutter cleaner which reduces the periodic requirement of a building owner to climb a ladder and manually clean out the downspout region of their rain gutters.

Still a further object of the present invention is to provide a gutter cleaner that will remain in place in the downspout region of a rain gutter.

Yet another object of the present invention is to provide a gutter cleaner that will fit a variety of rain gutter sizes.

The gutter cleaner, also called a gutter bobber, comprises a float portion and a stem portion. The float portion comprises a float piece that typically has a size larger than the downspout opening of a gutter in which the gutter cleaner is installed. Accordingly, the float will not flow down or become lodged in the downspout. The float piece is made of materials or in a manner such that the float piece will be raised within the gutter when water flows there through. The stem portion typically is attached to the float portion and extends downwardly into the downspout of the gutter. As rainwater flows into the gutter and down the downspout, the water will raise the float while the stem portion will remain extending downwardly into the downspout. The flow of the water agitates the stem and the float regions of the gutter cleaner. This agitation action reduces the buildup of small twigs and pine needles, thereby facilitating the flow of debris down the downspout. In this manner, the gutter cleaner reduces the accumulation of debris at the downspout region.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 1 is a perspective view of a building with a rain gutter installed thereon;

FIG. 2 is a side sectional view of a rain gutter wherein debris has accumulated FIG. 3 is a perspective view of a preferred embodiment of the gutter cleaner of the present invention;

FIG. 4 is a side sectional exploded view of the gutter cleaner of FIG. 3;

FIG. 6 is a side sectional view of the gutter cleaner positioned in a gutter having rainwater and debris flowing there through;

DETAILED DESCRIPTION

Figure 6:
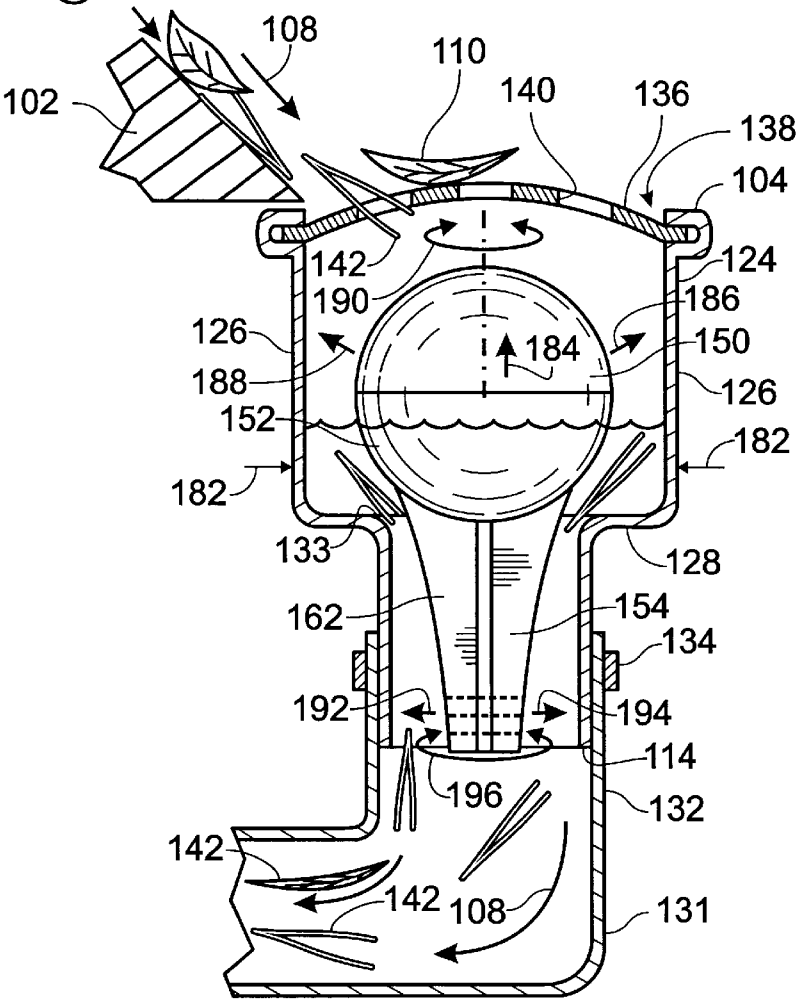

FIG. 1 shows a perspective view of a building with a rain gutter installed thereon. In particular, building 100 includes a peaked roof 102 having a rain gutter system 104 installed along an edge 106 of the roof. Conventional gutter systems may also be installed on relatively flat roofs and on interior regions of roofs. The gutter cleaner of the present invention will function in all of these gutter systems so long and there is a downspout region within the gutter system.

Rain 108 is shown falling on roof 102 and carries debris 110 into the gutter system. Debris 110 may comprise leaves, pine needles, nuts, seed pods, small branches and twigs, pieces of moss, and the like. The gutter system typically is installed on the roof at an angle so that water and debris flowing into the gutter will flow in a direction 112 toward a downspout 114. Ideally, the rainwater and debris will flow down the downspout and out a lower downspout opening 116, or into a rain collection or sewer system (not shown). Accordingly, the rainwater is channeled away from a foundation 118 of the building. When the downspout of the gutter system becomes clogged, rainwater will flow over an edge 120 of the gutter and create a puddle 122 adjacent the building's foundation. This puddling of water may lead to water in the building's basement and/or deterioration of the building's foundation.

FIG. 2 shows a side sectional view of a rain gutter wherein debris 110 has accumulated in the downspout region. Gutter assembly 104 includes a long gutter portion 124 that extends along the length of the roof and which includes upwardly extending side walls 126 and a lower wall 128. The lower and side walls channel water along the gutter to the downspout. The long gutter portion is attached to downspout 114 which includes a lip 130. The lip of the gutter may be secured to a downspout extension 132 by a clamp 134 or other fastening means as known in the art.

Downspout extension 134 typically includes a ninety degree bend 131 just below a downspout opening 133 so that downspout extension 132 may be positioned adjacent the side of the building along a majority of a length of the downspout extension. A distance 135 from opening 133 adjacent lower wall 128 of the gutter to bend 131 typically is approximately eight inches or more. Accordingly, the gutter cleaner of the present invention typically should not extend below opening 133 a distance more than eight inches so that the gutter cleaner will not contact the downspout extension at bend 131.

Still referring to FIG. 2, a mesh 136 may be secured within recesses 138 in an upper portion of long gutter 124 so that large debris, such as leaves, large branches and the like, is prevented from falling into the gutter. Mesh 136 includes apertures 140 for the passage of water therethrough. These apertures, however, also allow the passage of small debris 142 having a small diameter such as small branches, twigs, small leaves, and pine needles. Small branches, twigs, leaves, and pine needles 142, due to their long length and/or small diameter, often become entangled at downspout region 114 and form a dam 144. Dam 144 inhibits and often times completely prevents the flow of water from gutter 124 to downspout extension 132.

FIG. 3 shows a perspective view of a preferred embodiment of the gutter cleaner of the present invention. Gutter cleaner 150 includes a float portion 152 and a stem portion 154 attached thereto. In a preferred embodiment float portion 152 comprises a cylindrically symmetrical ball so that the float is not rotated out of position within the gutter system during use, as will described in more detail below. Float portion 152 comprises a top half 156 and a bottom half 158 which are molded of plastic in the shape of hollow half spheres. The two half regions are snapped together to form a watertight ball having a hollow interior that is filled with air. Accordingly, due to the air filled interior region, float portion 152 will float on water and is said to have an overall density less than that of water. In the embodiment wherein the gutter cleaner is installed in a standard residential gutter, float portion 152 has a diameter 160 of approximately four inches. The float portion may be sized to fit any gutter, but generally will have a diameter in a range of two to ten inches. For purposes of this description, the term "diameter" shall be used to indicate the largest measured distance across an object but shall not be limited in definition to refer to round objects. In other words, the term "diameter" may used to describe the width across a square object. In other embodiments, float portion 152 may be manufactured as a solid ball of expanded rigid polystyrene plastic such as Styrofoam (Trademark), as a solid ball of low-density plastic, wood, cork, or as a hollow ball of rubber having a plug to create a water tight air-filled interior region. The overall "density" of the float, including the density of the hollow air-filled interior, is lower than that of water such that the float will float on the surface of water contained within the gutter. Those skilled in the art will understand that any material may be to used which allows the float portion to rise with the water level within the gutter.

Stem portion 154 is secured to bottom half 158 by any securement means as known in the art. In the preferred embodiment, the stem is molded of plastic together with bottom half 158 of the float as a single piece. This is the most cost-effective manner of manufacturing and assembling the gutter cleaner. In other embodiments, stem portion 158 may be secured to bottom half 158 by a snap fastener, an adhesive, a threaded fastener, or the like. Stem portion 154 typically has four fins 162 extending outwardly from a central axis 164 wherein the fins facilitate agitation and rotational movement of the gutter cleaner as water flows past the fins and down the gutter's downspout. The stem typically has an average diameter 166 of approximately one- half inch and a length 168 of approximately five inches. The diameter of the stem portion typically decreases along the stem portion away from the float portion. This tapering of the stem portion helps to retain the gutter cleaner within the downspout opening. The diameter may range from one quarter inch to several inches, and the length of the stem portion may be manufactured in any size but typically will be in a range of two to ten inches. In a preferred embodiment, stem portion 154 has a density greater than that of water such that the stem portion weights the float portion down. slightly and acts as an anchor to retain the gutter cleaner in place. Accordingly, the stem portion may also be referred to as an anchor.

Stem portion 154 may include a pattern of indentations 170, 172 and 174 positioned perpendicular to central axis 164. Accordingly, the stem portion may be snapped off at any of indentations 170, 172 or 174 so that the length of the stem can be adjusted to fit the length of any downspout as desired. In particular, the stem portion of the gutter cleaner should not be longer than distance 135 (shown in FIG. 2) which extends from opening 133 adjacent lower wall 128 of the gutter to bend 131. In other embodiments, the stem portion may include notches, or be manufactured of an easily cuttable material such as rope or wood, that facilitates cutting of the stem portion to a desired length. In other words, the stem portion of the gutter cleaner should be of a short enough length so that the float portion of the gutter cleaner is able to rest on the downspout opening when the gutter is dry. In addition, the length of the stem portion should be longer than a depth 175 (FIG. 2) of side walls 126 of the gutter so that when the gutter is filled with water, the stem will not be displaced from downspout opening 116. This length will facilitate the desired agitation and rotational movement of the gutter cleaner when rain and debris flow into the gutter, as will be described below, without displacement of the gutter cleaner from the downspout of the gutter system.

FIG. 4 shows a side sectional exploded view of the gutter cleaner taken along line 4—4 of FIG. 3. Top half 156 of the float includes a recess 176 for receiving a mating snap protrusion 178 on bottom half 158 of the float portion. When snapped together, the two halves define an airtight hollow interior 180.

Figure 5:
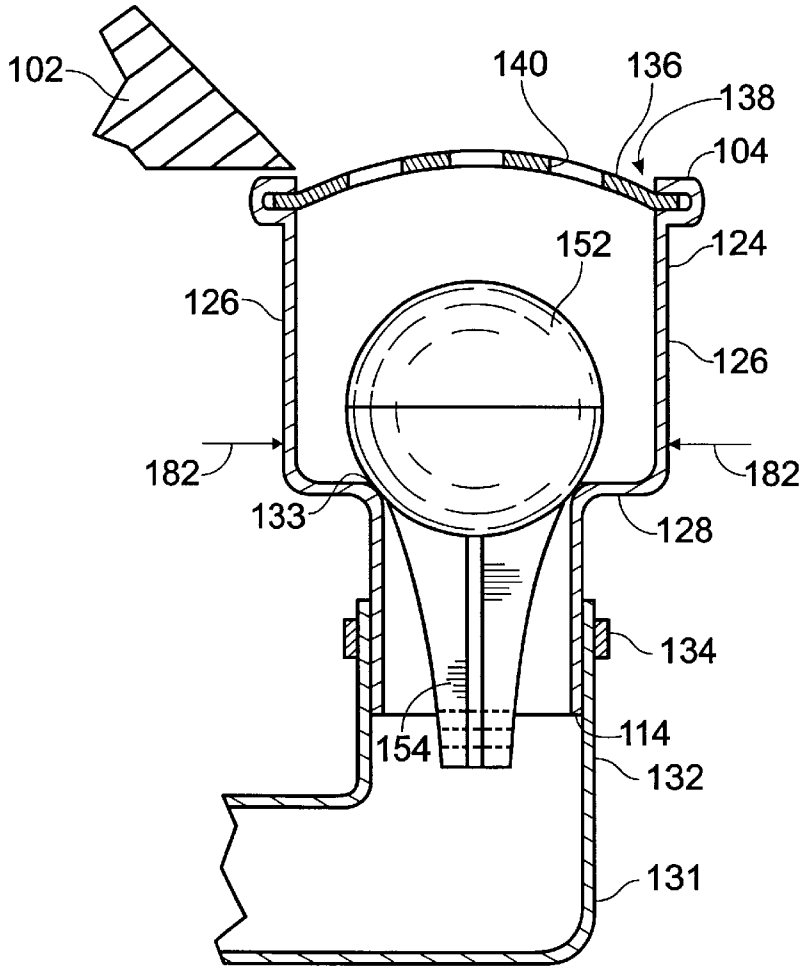
FIG. 5 is a side sectional view of the gutter cleaner placed in a dry gutter.

FIG. 5 shows a side sectional view of the gutter cleaner placed in a dry gutter. In particular, float portion 152 rests on downspout opening 133 and stem portion 154 extends downwardly into downspout region 114. Due to the length of stem portion 154, and due to the diameter of the float portion which ideally extends across at least half of a width 182 of the gutter from one side wall 126 to the other side wall 126, the gutter cleaner is not easily removed from the gutter even during periods of high winds and stormy conditions. Accordingly, gutter cleaner 150 will be properly positioned in the gutter when rain falls on the building's roof. A property owner, therefore, is not required to periodically insert and remove the gutter cleaner but instead may initially install the gutter cleaner and then leave the cleaner in place indefinitely.

FIG. 6 shows a side sectional view of the gutter cleaner positioned in a gutter having rainwater and debris flowing there through. During periods of rain or melting snow, water 108 flows into gutter 104 and carries debris 110 therewith. Small diameter debris 142 typically flows with the water through apertures 140 in mesh netting 136 and into the gutter. The water flows along the length of gutter portion 124 and toward downspout 132. The water in the gutter raises float 152 in an upward direction 184 such that the water is allowed to flow under and around the float and downwardly into downspout extension 132. The stem portion of the gutter cleaner extends downwardly into downspout opening 133 thereby retaining the gutter cleaner in place.

The flow of water around and under float portion 152 causes the float to rock back and forth in directions 186 and 188, and to rotate in directions 190. In addition. the flow of water and debris through the downspout causes fins 162 on stem portion 154 to rock back and forth or agitate in directions 192 and 194, and to rotate in directions 196. Accordingly, as water and individual pieces of debris 142 encounter gutter cleaner 150, the cleaner is agitated within the downspout thereby facilitating the agitation of debris at the downspout. Due to agitation of the debris in the downspout region, individual pieces of debris tend to flow downwardly with water 108, rather than accumulating to form a dam at the downspout region. When the rain flow into the gutter ceases, the gutter cleaner will drop with the water level to once again be seated at the downspout opening, ready for the next flow of water and debris.

Figure 7:
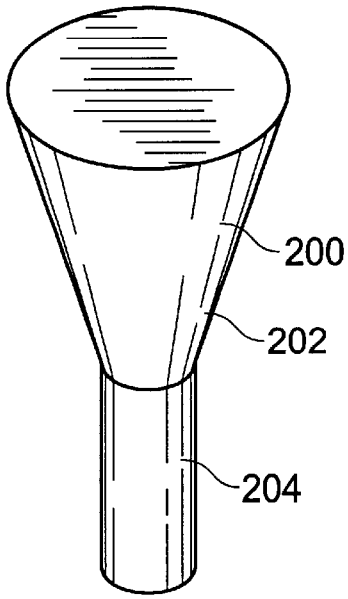
FIG. 7 is a perspective view of another embodiment of the gutter cleaner.

FIG. 7 shows a perspective view of another embodiment of the gutter cleaner. Gutter cleaner 200 includes a cone shaped float portion 202 manufactured of rigid foam having a density less than water and a stem portion 204 manufactured of a cylindrical wooden piece, such as a length of a dowel rod, which is glued to the float. The dowel may also be press fit into a recess within the rigid foam float to secure the stem to the float. The stem portion may also be manufactured of plastic, cork including a weight therein, metal, or any other material having an overall density greater than that of water.

Figure 8:
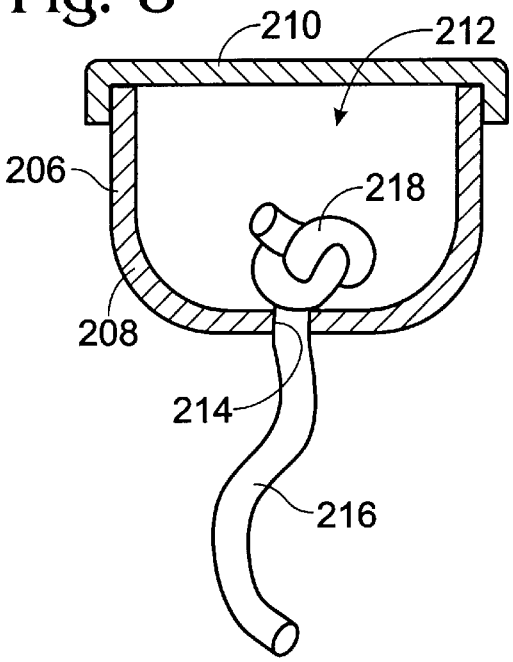
FIG. 8 is a side sectional view of another embodiment of the gutter cleaner.

FIG. 8 shows a perspective view of another embodiment of the gutter cleaner. Gutter cleaner 206 comprises a cup shaped hollow float portion 208 and a cap 210 secured thereto to create an airtight hollow interior 212. Float 208 typically is manufactured of rubber or the like but may also be made of rigid polystryene plastic foam. Cup shaped float 208 includes an aperture 214 for receiving an end of a rope 216 having a knot 218 tied therein. Rope 216 extends downwardly from float 208 and forms the stem portion of gutter cleaner 206. Rope 216 may also be a wire or any other type of stem extension which is flexible with respect to float portion 208. The rope may be cut to any length as desired.

Figure 9:
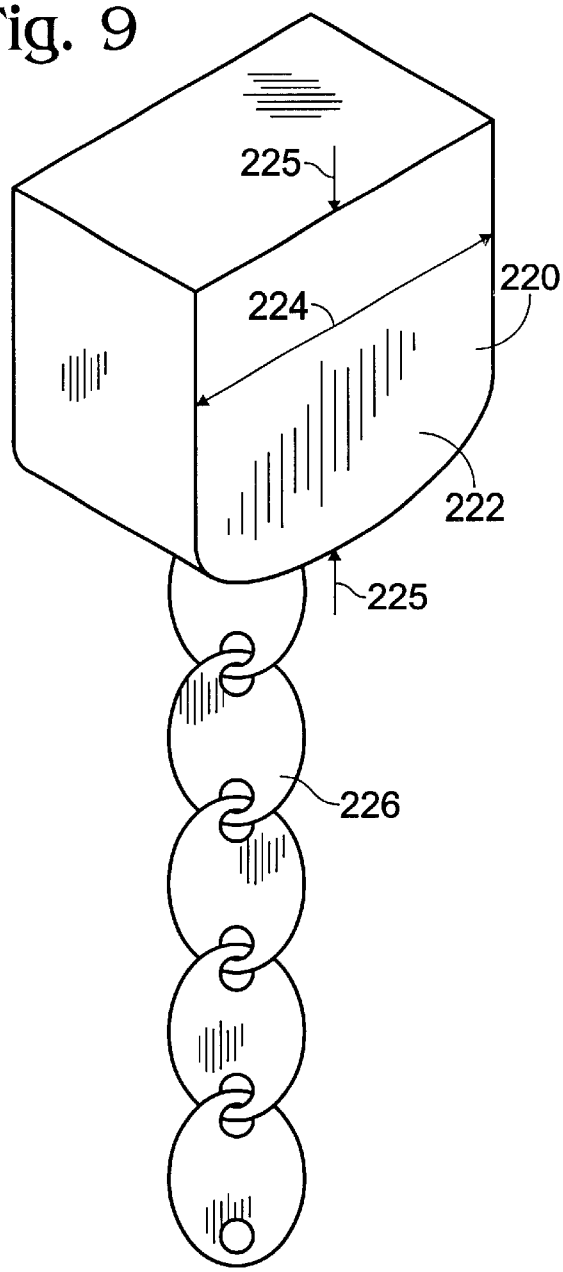
FIG. 9 is a perspective view of another embodiment of the gutter cleaner.

FIG. 9 shows a perspective view of another embodiment of the gutter cleaner. Gutter cleaner 220 comprises a float portion 222 having width 224 slightly smaller than a width of the gutter in which the gutter cleaner is installed. The float has a cross-sectional shape similar to that of the cross-sectional shape of the gutter and a height 225 which is less than a height 175 (FIG. 2) of the side walls of the gutter system. Accordingly, the float typically will not rotate within the gutter but will rise with the water level in the gutter and will rock back and forth slightly within the gutter during water flow. This embodiment may be preferred in extremely stormy environments wherein a lip created by recesses 138 (FIG. 2) at the upper portion of the gutter facilitates retention of the gutter cleaner in the gutter.

Gutter cleaner 220 further comprises an anchor 226 made up of several links 228 which form a chain. The amount of links may be controlled to control the length of the anchor portion. The links typically are substantially solid across their width such that twigs and pine needles cannot become caught within the links. The links are secured to the float and to one another such that the individual links can move relative to one another along the length of the chain. Accordingly, as water and debris flow into the downspout region, the links will move in a whip type motion so as facilitate flow of the debris down the downspout and so as to inhibit accumulation of the debris at the downspout.

Figure 10:
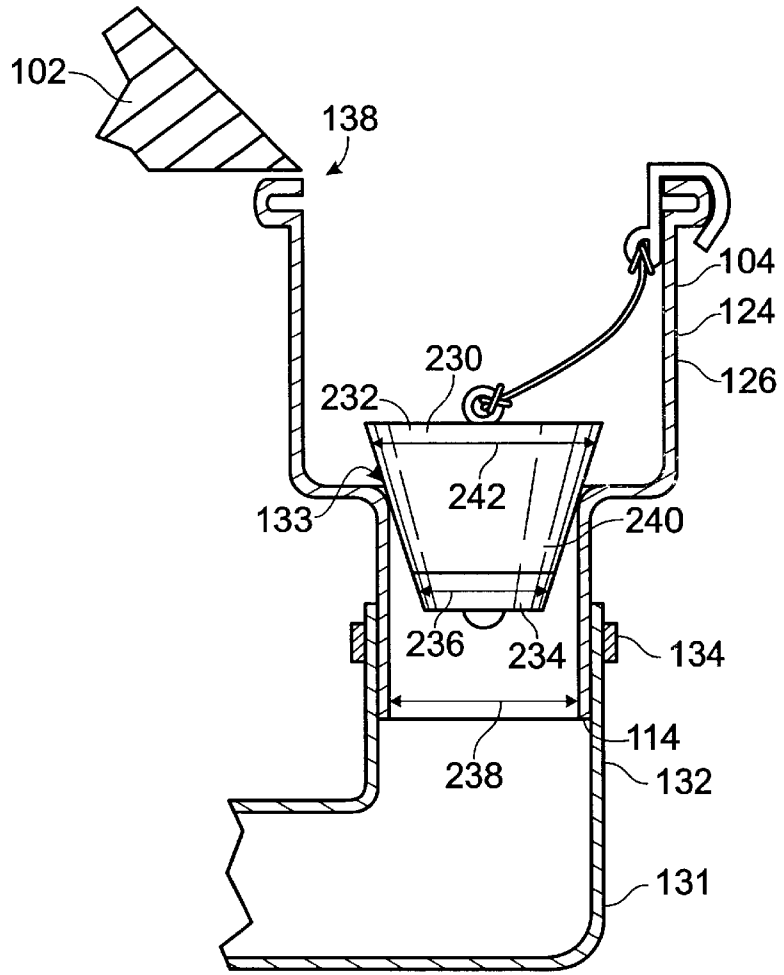
FIG. 10 is a side sectional view of another embodiment of the gutter cleaner placed within a dry gutter.

FIG. 10 shows a side sectional view of another embodiment of the gutter cleaner placed within a gutter. In this embodiment, gutter cleaner 230 includes a conical shaped float portion 232. A lowermost portion 234 of the float has a diameter 236 which is smaller than a diameter 238 of opening 133 of downspout 132. Accordingly, the lowermost portion of float 232 is defined as a stem portion 240. When gutter 124 is dry, stem 240 is seated within downspout opening 133. An upper diameter 242 of the float portion is larger than diameter 238 of downspout 133 opening thereby retaining the cleaner in place at the downspout region.

Figure 11:
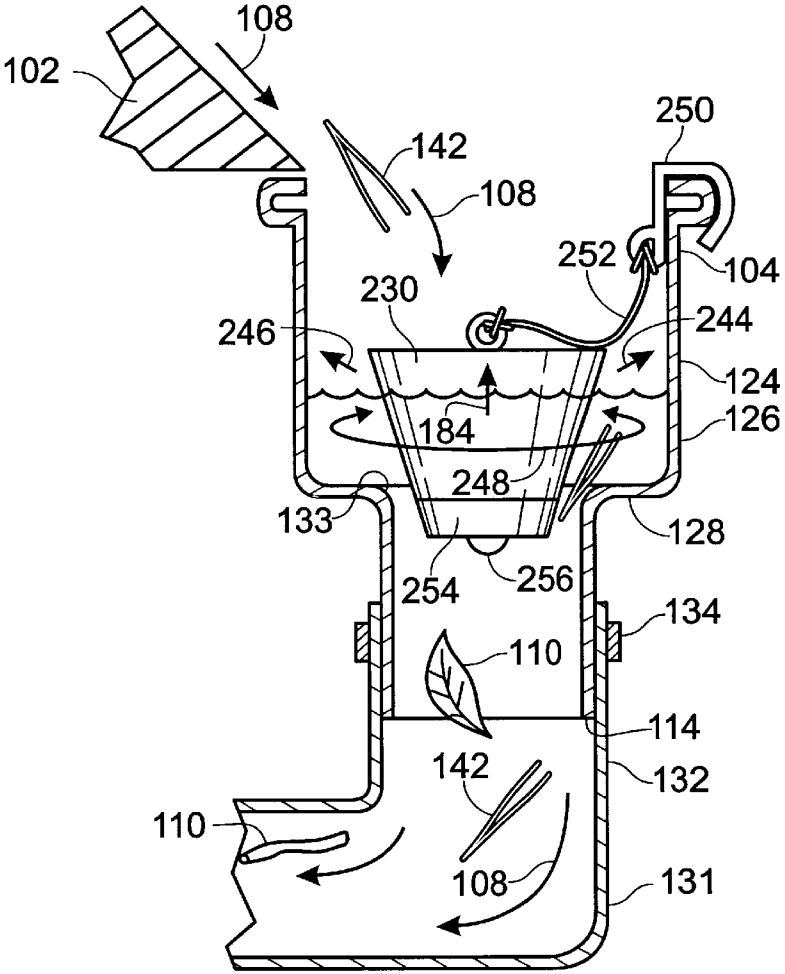
FIG. 11 is a side sectional view of the gutter cleaner of FIG. 10 showing agitation of the gutter cleaner when rainwater and debris flow through the gutter.

FIG. 11 is a side sectional view of the gutter cleaner of FIG. 10 showing agitation of the gutter cleaner when rainwater and debris flow through the gutter. When water 108 and debris 110 flow into gutter 124, the water level raises gutter cleaner 230 in direction 184 so that the water and debris can flow around and under the cleaner. The cleaner, including the smaller diameter stem portion, are agitated and rotated in directions 244, 246 and 248, respectively, within the downspout region so as to facilitate flow of the water and debris down the downspout and so as to inhibit the accumulation of debris at the downspout region. As shown in this figure, the gutter cleaner of the present invention may be used with or without a mesh netting to facilitate flow of debris 110 and 142 down the gutter downspout.

Gutter cleaner 230 may be secured in place with use of a hook 250 secured to an upper lip of gutter 124, wherein the float is secured to the hook by a flexible fastener 252, such as string or a wire. In this embodiment, float 232 typically is manufactured of cork. A metal weight 254 may be secured to the bottom portion of stem 240 so as to weigh the float down slightly during water flow in the gutter. In this embodiment, a fastener 256 may extend along the length of and through the gutter cleaner so that the fastener secures weight 254 and string 252 to the gutter cleaner. In this embodiment, the weight may be referred to as the anchor portion of the gutter cleaner.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

We claim:

1. A self cleaning gutter assembly comprising:

a gutter system including an elongate gutter portion having a rain collection portion that defines a width, and a downspout defining an opening having a width wherein said downspout is attached to said elongate gutter portion; and a gutter cleaner installed in said gutter system at said downspout and including a top portion and a bottom portion, said top portion having a width less than said width of the rain collection portion of the elongate gutter portion and greater than said width of said downspout opening, and said bottom portion having a width less than said width of said downspout opening, wherein said top portion has a density lower than a density of water, and said bottom portion has a density higher than the density of water.

2. A self cleaning gutter assembly comprising:

a gutter system including an elongate gutter portion having a rain collection portion that defines a width, and a downspout defining an opening having a width wherein said downspout is attached to said elongate gutter portion; and a gutter cleaner installed in said gutter system at said downspout and including a top portion and a bottom portion, said top portion having a width less than said width of the rain collection portion of the elongate gutter portion and greater than said width of said downspout opening, and said bottom portion having a width less than said width of said downspout opening, wherein said bottom portion includes fins, a central axis, and indentations positioned normal to said central axis.

3. A self cleaning gutter assembly comprising:

a gutter system including an elongate gutter portion having a rain collection portion that defines a width, and a downspout defining an opening having a width wherein said downspout is attached to said elongate gutter portion; and a gutter cleaner installed in said gutter system at said downspout and including a top portion and a bottom portion, said top portion having a width less than said width of the rain collection portion of the elongate gutter portion and greater than said width of said downspout opening, and said bottom portion having a width less than said width of said downspout opening, wherein said top portion comprises first and second semi-spherical half sections which are snapped together to define an airtight hollow interior, wherein said top portion has a diameter in a range of two to five inches, and wherein said bottom portion has a length in a range of two to seven inches.

4. A self cleaning gutter assembly comprising:

a gutter system including an elongate gutter portion having a rain collection portion that defines a width, and a downspout defining an opening having a width wherein said downspout is attached to said elongate gutter portion; and a gutter cleaner installed in said gutter system at said downspout and including a top portion and a bottom portion, said top portion having a width less than said width of the rain collection portion of the elongate gutter portion and greater than said width of said downspout opening, and said bottom portion having a width less than said width of said downspout opening, wherein said bottom portion is flexible along its length with respect to said top portion.

* * * * *